United States Patent [19]

Schwartz

[11] Patent Number: 4,923,782

[45] Date of Patent: May 8, 1990

[54] PHOTOGRAPHIC STABILIZING BATH CONTAINING HYDROLYZED POLYMALEIC ANHYDRIDE

[75] Inventor: Paul A. Schwartz, Webster, N.Y.

[73] Assignee: Eastman Kodak Company, Rochester, N.Y.

[21] Appl. No.: 202,729

[22] Filed: Jun. 3, 1988

[51] Int. Cl.[5] ..... G03C 5/39; G03C 11/00

[52] U.S. Cl. ..... 430/372; 430/393; 430/460; 430/490; 430/491

[58] Field of Search ..... 430/372, 393, 460, 490, 430/491; 252/175, 180; 210/698, 701

[56] References Cited

U.S. PATENT DOCUMENTS

| | | | |
|---|---|---|---|
| 3,810,834 | 5/1974 | Jones et al. | 210/58 |
| 4,615,971 | 10/1986 | Häseler | 430/491 |
| 4,786,583 | 11/1988 | Schwartz | 430/372 |

OTHER PUBLICATIONS

"Polyelectrolytes As Calcium Controlling Agents In Photographic Processing Solutions", Research Disclosure, No. 229, Item 22937, May 1983.

"Use of Copolymers Of Maleic Acid And Other Monomers in Photographic Processing Solutions", Research Disclosure, No. 253, Item 25332, May 1985.

*Primary Examiner*—Hoa Van Le

*Attorney, Agent, or Firm*—Alfred P. Lorenzo

[57] ABSTRACT

A stabilizing bath which provides reduced stain and enhanced dye stability for photographic color elements which are processed therein is comprised of a dye stabilizing agent, an alkanolamine, and a hydrolyzed polymaleic anhydride or water-soluble salt thereof. The stabilizing bath is used as a final processing bath which follows treatment of the element in a fixing or bleach-fixing bath containing a thiosulfate fixing agent. The alkanolamine functions to prevent the precipitation of sulfur resulting from carryover of the thiosulfate fixing agent into the stabilizing bath, while the hydrolyzed polymaleic anhydride or water-soluble salt thereof functions to avoid the formation of unwanted precipitates.

20 Claims, No Drawings

PHOTOGRAPHIC STABILIZING BATH CONTAINING HYDROLYZED POLYMALEIC ANHYDRIDE

CROSS-REFERENCE TO RELATED APPLICATIONS

U.S. patent application Ser. No. 064,633, "Stabilizing Bath For Use in Photographic Processing", P. A. Schwartz, filed June 22, 1987, now U.S. Pat. No. 4,786,583 issued Nov. 22, 1988, describes photographic stabilizing baths comprising a dye stabilizing agent and an alkanolamine.

U.S. patent application Ser. No. 202,728 "Photographic Stabilizing Bath Containing Polyacrylic Acid", P. A. Schwartz filed June 3, 1988 describes photographic stabilizing baths comprising a dye stabilizing agent, an alkanolamine and polyacrylic acid or a water soluble salt thereof.

FIELD OF THE INVENTION

This invention relates in general to color photography and in particular to methods and compositions for use in the processing of color photographic elements. More specifically, this invention relates to a novel stabilizing bath which is useful in photographic color processing to provide reduced stain and enhanced dye stability.

BACKGROUND OF THE INVENTION

Multicolor, multilayer photographic elements are well known in the art of color photography. Usually, these photographic elements have three different selectively sensitized silver halide emulsion layers coated on one side of a single support. The vehicle used for these emulsion layers is normally a hydrophilic colloid, such as gelatin. One emulsion layer is blue sensitive, another green-sensitive and another red-sensitive. Although these layers can be arranged on a support in any order, they are most commonly arranged with the support coated in succession with the red-sensitive layer, the green-sensitive layer and the blue-sensitive layer (advantageously with a bleachable blue light-absorbing filter layer between the blue-sensitive layer and the green-sensitive layer) or with the opposite arrangement and no filter layer. Colored photographic images are formed from latent images in the silver halide emulsion layers during color development by the coupling of oxidized aromatic primary amine color developing agent with couplers present either in the color developer solution or incorporated in the appropriate light sensitive layers. Color photographic elements containing dye images usually utilize a phenolic or naphtholic coupler that forms a cyan dye in the red sensitive emulsion layer, a pyrazolone or cyanoacetyl derivative coupler that forms a magenta dye in the green sensitive emulsion layer and an acetylamide coupler that forms a yellow dye in the blue-sensitive emulsion layer. Diffusible couplers are used in color developer solutions. Non diffusing couplers are incorporated in photographic emulsion layers. When the dye image formed is to be used in situ, couplers are selected which form non diffusing dyes. For image transfer color processes, couplers are used which will produce diffusible dyes capable of being mordanted or fixed in the receiving sheet.

It is well known in the photographic art to utilize a stabilizing bath as the final step in the processing of both color films and color papers. Such baths can serve to reduce stain and/or enhance dye stability. A wide variety of different stabilizing compositions have been proposed for such use. Thus, the known stabilizing baths include those containing addition products of formaldehyde and a diazine or triazine as described in Mackey et al., U.S. Pat. No. 2,487,569 issued Nov. 8, 1949; aliphatic aldehydes as described in Harsh et al, U.S. Pat. No. 2,518,686 issued Aug. 15, 1950; addition products of formaldehyde and a urea, as described in Mackey, U.S. Pat. No. 2,579,435 issued Dec. 18, 1951; tetramethylol cyclic alcohols or ketones as described in Clarke et al, U.S. Pat. No. 2,983,607 issued May 9, 1961; glucoheptonates as described in Bard, U.S. Pat. No. 3,157,504 issued Nov. 17, 1964; amino acids as described in Jeffreys, U.S. Pat. No. 3,291,606 issued Dec. 13, 1966; mixtures of an aldehyde and an alkoxy substituted polyoxyethylene compound as described in Seemann et al, U.S. Pat. No. 3,369,896 issued Feb. 20, 1968; compounds comprising a tri(hydroxymethyl)methyl group as described in Jeffreys et al, U.S. Pat. No. 3,473,929 issued Oct. 21, 1969; and addition complexes of an alkali metal bisulfate and an aldehyde as described in Mowrey, U.S. Pat. No. 3,676,136 issued July 11, 1972.

The formation of yellow stain in photographic color elements is believed to be related to the presence of unreacted coupler in emulsion layers and to be influenced by a number of factors such as heat, humidity, conditions to which the photographic element was subject in development, e.g., development time, of developing composition, such as contamination by bleaching agents, and so forth. Dye stability is believed to also be affected by the presence of unreacted coupler in emulsion layers (since coupler and dye can react slowly with one another to degrade a color image) and to be influenced by such factors as temperature, humidity, ambient oxygen, and the spectral distribution and intensity of the light to which the dye image is subjected. Magenta dye stability is a particular problem, as the magenta dye image tends to fade much more rapidly than either the cyan dye image or the yellow dye image. Thus, the problems of stain formation and dye stability are interrelated and highly complex, and the stabilizing compositions known heretofore have typically been deficient in one or more respects as regards the overcoming of these problems.

Processes which are intended for rapid access processing of photographic color elements pose a particular difficulty with respect to the provision of an effective stabilizing bath. In order to shorten the total processing time, such processes typically do not have a wash step following the fixing or bleach-fixing step, and in consequence, the element passes directly from the fixing or bleaching-fixing bath into the stabilizing bath. This results in carryover of the fixing agent, which is usually a thiosulfate, into the stabilizing bath. The result of such carryover is decomposition of the thiosulfate and precipitation of elemental sulfur in the stabilizing bath with resultant fouling of both the processing apparatus and the photographic element. This problem is commonly referred to as "sulfurization" of the stabilizing bath.

A novel stabilizing bath that is highly effective in reducing yellow stain formation and increasing dye stability, and which eliminates or greatly reduces the tendency for sulfurization to occur, is described in the aforesaid U.S. patent application Ser. No. 064,633, filed June 22, 1987. This stabilizing bath is comprised of a dye stabilizing agent and a sufficient amount of an alkanolamine to effectively retard sulfurization. One problem in the use of such a bath however, is the tendency for the formation of precipitates to occur. These precipitates are typically a result of the presence of calcium ions. The source of the calcium can be the photographic emulsion layers of the photographic element undergoing processing or the use of hard water in the formation or replenishment of the processing solutions. Such formation of precipitates is highly undesirable, as it can lead to the formation of sludge in the processing solutions, scum on the photographic elements that are processed therein, and scale on the equipment used in processing.

In an attempt to avoid the problem of calcium precipitates, it has long been the practice in the photographic art to complex the calcium in an unionized form by the use of a sequestering agent. Among the sequestering agents which have been proposed for this purpose are polyphosphates, polycarboxylic acids, hydroxy acids such as gluconic acid, oxyacetic acids such as diglycolic acid, pyridine carboxylic acids, and organophosphonates. However, there are many problems associated with the use of these sequestering agents. Examples of such problems include insufficient sequestering power, a tendency to undergo hydrolysis in the processing solution, a processing agents, and a tendency to undergo reactions leading to the formation of insoluble compounds. Patents relating to the use of sequestering agents in photographic processing compositions include U.S. Pat. Nos. 2,172,216, 2,541,470, 2,656,273, 2,875,049, 3,201,246, 3,462,269, 3,746,544, 3,839,045, 3,994,730, 4,083,723, 4,142,895 and 4,264,716 and British Pat. Nos. 712,356, 795,914, 1,251,462, 1,495,504 and 1,496,326.

Of particular importance among the classes of sequestering agents which are used commercially in both color and black-and-white processing compositions—for the purpose of preventing, or at least reducing, the precipitation of calcium salts—are the aminopolycarboxylic acids and the aminopolyphosphonic acids. In some instances, only a single sequestering agent is employed, but it is also well known to use mixtures of two or more sequestering agents, including mixtures of two or more different members of the class of aminopolycarboxylic acids, mixtures of two or more different members of the class of aminopolyphosphonic acids, and mixtures of at least one aminopolycarboxylic acid with at least one aminopolyphosphonic acid.

In a stabilizing bath of the type containing a dye stabilizing agent and an alkanolamine, as described in the aforesaid U.S. patent application Ser. No. 064,633 filed June 22, 1987, it is a particularly difficult problem to reduce or eliminate the formation of unwanted precipitates. This stabilizing bath is used as the final bath in the process and is not washed from the photographic element. Thus, the components of the stabilizing bath remain in the element during the drying step and must be able to withstand the elevated temperatures used in drying. When subjected to such conditions, sequestering agents of either the aminopolycarboxylic acid type or the aminopolyphosphonic acid type tend formation of yellow stain during storage, with a resulting increase in $D_{min}$ that is highly undesirable. Thus, while they alleviate the problem of precipitates of calcium they cause a staining problem that renders their use impractical.

It is toward the objective of providing a novel stabilizing bath that increases dye stability, avoids precipitate formation, reduces the tendency for sulfurization to occur, and does not cause staining that the present invention is directed.

SUMMARY OF THE INVENTION

In accordance with this invention, a novel stabilizing composition is utilized to provide improved dye stability to photographic color elements which are comprised of a support having thereon at least one hydrophilic colloid layer containing a dye image. The stabilizing composition comprises an aqueous solution of a dye stabilizing agent, an alkanolamine, and a hydrolyzed polymaleic anhydride or water soluble salt thereof. The stabilizing composition can be applied to the photographic element in any suitable manner, such as by its use as the final processing step of a conventional photographic process, i.e., the step which immediately precedes the drying step. It provides reduced stain and improved dye stability, is strongly resistant to sulfurization, and exhibits little or no tendency to form precipitates.

DESCRIPTION OF THE PREFERRED EMBODIMENTS

The stabilizing composition of this invention can be used to provide improved dye stability with any of a wide variety of color photographic elements. Thus, for example, the stabilizing composition can be advantageously employed in the processing of photographic elements designed for reversal color processing or in the processing of negative color elements or color print materials. The stabilizing composition can be employed with photographic elements which are processed in color developers containing couplers or with photographic elements which contain the coupler in the silver halide emulsion layers or in layers contiguous thereto. The photosensitive layers present in the photographic elements processed according to the method of this invention can contain any of the conventional silver halides as the photosensitive material, for example, silver chloride, silver bromide, silver bromoiodide, silver chlorobromoiodide, and mixtures thereof. These layers can contain conventional addenda and be coated on any of the photographic supports, such as, for example, cellulose nitrate film, cellulose acetate film, polyvinyl acetal film, polycarbonate film, polystyrene film, polyethylene terephthalate film, paper, polymer-coated paper, and the like.

The photographic elements which are advantageously treated with the stabilizing composition of this invention are elements comprising a support having thereon at least one, and typically three or more, hydrophilic colloid layers containing a dye image. Any of a wide variety of colloids can be utilized in the production of such elements. Illustrative examples of such colloids include naturally occurring substances such as proteins, protein derivatives, cellulose derivatives—e.g., cellulose esters, gelatin—e.g., alkali-treated gelatin (cattle bone or hide gelatin) or acid treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot albumin and the like.

In the production of color photographic images, it is necessary to remove the silver image, which is formed coincident with the dye image. This can be done by oxidizing the silver by means of a suitable oxidizing agent, commonly referred to as a bleaching agent, in the presence of halide ion followed by dissolving the silver halide so formed in a silver halide solvent, commonly referred to as a fixing agent. Alternatively, the bleaching agent and fixing agent can be combined in a bleach-fixing solution and the silver removed in one step by use of such solution.

Color print papers are most commonly processed by use of a bleach-fixing solution. Color negative films are most commonly processed by use of separate bleaching and fixing solutions. The bleaching agent is typically a ferric complex of an aminopolycarboxylic acid, for example, the ferric complex of ethylenediameinetetraacetic acid (EDTA) or the ferric complex of 1,3-propylenediaminetetraacetic acid (PDTA) or a mixture of the ferric complex of EDTA and the ferric complex of PDTA. The fixing agent is typically a thiosulfate, such as sodium thiosulfate or ammonium thiosulfate, or a thiocyanate, such as ammonium thiocyanate, or a mixture of a thiosulfate and a thiocyanate.

Processes employing the stabilizing composition of this invention can vary widely in regard to the particular processing steps utilized. For example, the process can comprise only the &two steps of color developing and bleach-fixing, followed by the stabilizing step, or it can comprise the three steps op color developing, bleaching, and fixing, followed by the stabilizing step. Alternatively, it can be a color reversal process in which the processing baths utilized are a first developer, a reversal bath, a color developer, a bleach, and a fix, followed by the stabilizing bath.

Any of the well known dye stabilizing agents known to be useful in photographic color processing can be employed in the stabilizing baths of this invention. Particularly useful dye stabilizing agents include hexamethylenetetramine, aliphatic aldehydes such as formaldehyde, paraformaldehyde, acetaldehyde, aldol, crotonaldehyde, propionaldehyde, and the like, and N-methylol compounds such as dimethylol urea
trimethylol urea
dimethylol guanidine
trimethylol melamine
tetramethylol melamine
pentamethylol melamine
hexamethylol melamine
1,3 dimethylol-5,5-dimethyl hydantoin and the like.

In addition to the dye stabilizing agent, the stabilizing baths of this invention contain an alkanolamine and a hydrolyzed polymaleic anhydride or water soluble salt thereof. The use of alkanolamines in such baths is based on the unexpected discovery—disclosed in the aforesaid U.S. patent application Ser. No. 064,633 filed June 22, 1987, —that they function effectively to retard sulfurization and thereby make it feasible to tolerate the carry in of thiosulfate fixing agent that occurs in processes that do not use a wash step after the fixing or bleach-fixing step. The mechanism whereby the alkanolamine causes this result is not clearly understood.

The term "alkanolamine", as used herein, refers to an amine in which the nitrogen atom is directly attached to a hydroxyalkyl group, i.e., the amine comprises an >N—X—OH group where X is alkylene. The radicals attached to the free bonds in the >N—X—OH group can be hydrogen atoms or organic radicals, e.g., unsubstituted hydrocarbon radicals or substituted hydrocarbon radicals. They are preferably hydrocarbyl radicals of 1 to 12 carbon atoms, for example, alkyl, aryl, alkaryl or aralkyl radicals.

Alkanolamines which are preferred for use in the stabilizing baths of this invention are compounds of the formula:

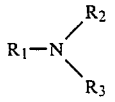

wherein $R_1$ is an hydroxyalkyl group of 2 to 6 carbon atoms and each of $R_2$ and $R_3$ is a hydrogen atom, an alkyl group of 1 to 6 carbon atoms, an hydroxyalkyl group of 2 to 6 carbon atoms, a benzyl radical, or a

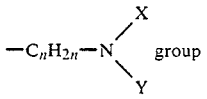

wherein n is an integer of from 1 to 6 and each of X and Y is a hydrogen atom, an alkyl group of 1 to 6 carbon atoms or an hydroxylalkyl group of 2 to 6 carbon atoms. Alkanolamines which are especially preferred are compounds of the formula:

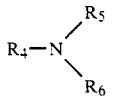

wherein $R_4$ is an hydroxyalkyl group of 2 to 4 carbon atoms and each of $R_5$ and $R_6$ is an alkyl group of to 4 carbon atoms or an hydroxyalkyl group of 2 to carbon atoms. Typical examples of alkanolamines which can be used in the stabilizing baths of this invention include:

ethanolamine
diethanolamine
triethanolamine
di-isopropranolamine
2-methylaminoethanol
2-ethylaminoethanol
2-dimethylaminoethanol
2-diethylaminothanol
1-diethylamino-2-propanol
3-diethylamino-1-propanol
3-dimethylamino-1-propanol
isopropylaminoethanol
3-amino-1-propanol
2-amino-2-methyl-1,3-propanediol
ethylenediamine tetraisopropanol
benzyldiethanolamine
2-amino-2-(hydroxymethyl)-1,3-propandiol and the like.

The hydrolyzed polymaleic anhydride which is used, in accordance with this invention, as a calcium-controlling agent in a stabilizing bath is a well known material. As indicated by the patent literature (see for example, U.S. Pat. Nos. 3,810,834, 3,897,209, 3,963,636 and 4,089,796), the exact structure of hydrolyzed polymaleic anhydride is not known with certainty. It is, however, readily prepared by hydrolyzing polymerized maleic anhydride to thereby form a polymeric product which contains free carboxylic acid groups, and possibly also residual anhydride groups, on a carbon backbone. For the purposes of this invention, the hydrolyzed polymaleic anhydride can be utilized as such or in the form of a water soluble salt, such as the sodium or potassium salts. The molecular weight of the hydrolyzed polymaleic anhydride utilized in accordance with this invention can range from a few hundred to several thousand. A preferred range is from about to about 2,500.

Hydrolyzed polymaleic anhydrides are polyelectrolytes, that is, ion-containing macromolecules which exhibit the combined properties of polymers and of electrolytes. Applicant is not certain of the mechanism whereby they function in his invention, and does not wish to be bound by any theoretical explanation of such mechanism. It is believed that they function to both complex calcium and to alter the crystalline form of calcium precipitates. The hydrolyzed polymaleic anhydride greatly reduces the amount of precipitate formation that would otherwise occur in the stabilizing bath and has the further advantage that precipitates which do form tend to be of a type which does not form a tenaciously adhering scale.

Details with respect to the preparation and properties of hydrolyzed polymaleic anhydrides are provided in U.S. Pat. No. 3,810,834 issued May 14, 1974, the disclosure of which is incorporated herein by reference.

Hydrolyzed polymaleic anhydrides are available commercially from Ciba-Geigy Corporation under the trademarks BELCLENE 200 and BELCLENE 500.

The use of hydrolyzed polymaleic anhydrides for scale control in boilers and cooling water systems is well known (see, for example, U.S. Pat. No. 3,810,834). Their use in photographic processing compositions has also been proposed heretofore in Research Disclosure, Item 22937, No. 229, May 1983 entitled "Polyelectrolytes As Calcium Controlling Agents In Photographic Processing Solutions" (Research Disclosure is published by Kenneth Mason Publications Ltd., 8 North Street, Emsworth, Hampshire, PO 107 DD United Kingdom) and in Haseler, U.S. Pat. No. 4,615,971, "Photographic Developer Composition" issued Oct. 7, 1986. Use of copolymers of maleic acid with other monomers to avoid calcium precipitates in photographic processing is disclosed in Research Disclosure, Item 25332, No. 253, May 1985 entitled "Use of Copolymers of Maleic Acid and Other Monomers in Photographic Processing Solutions". There is no suggestion in the prior art, however, to use hydrolyzed polymaleic anhydrides in stabilizing baths which contain both a dye stabilizing agent and an alkanolamine, to thereby avoid precipitate formation without causing a staining problem.

Other additives can also be incorporated in the stabilizing bath of this invention with beneficial results. Examples of useful additives include wetting agents, buffering agents and biocides. Wetting agents are particularly useful when processing color negative films to avoid water spotting. Organosiloxane wetting agents are especially beneficial and their stability in the stabilizing bath of this invention is enhanced by the presence of the alkanolamine. Biocides are useful to prevent microbial growth in both processes for color films and processes for color papers. A particularly useful class of biocides for this purpose are the thiazole compounds, especially isothiazolines such as 1,2-benzisothiazolin-3-one, 2-methyl-4-isothiazolin-3-one, 2-octyl-4-isothiazolin-3-one and 5-chloro-N-methyl-4-isothiazolin-3-one.

The ingredients utilized in making up the stabilizing composition of this invention can be used in any suitable amount and the optimum amount of each will vary widely depending on a number of factors such as the particular compounds employed, the manner of treating the photographic element with the stabilizing composition, and the particular type of photographic element which is to be treated.

Typically, the dye stabilizing agent is used in an amount of from about 0.1 to about 10 grams per liter of stabilizing solution, and more preferably in an amount of from about 0.4 to about 2 grams per liter; the alkanolamine is used in an amount of from about 0.5 to about 20 grams per liter of stabilizing solution, and more preferably in an amount of from about 1 to about 5 grams per liter, and the hydrolyzed polymaleic anhydride or water soluble salt thereof is used in an amount of from about 0.01 to about 1.0 grams per liter of stabilizing solution, and more preferably in an amount of from about 0.02 to about 0.5 grams per liter. The stabilizing solution is preferably employed at a pH in the range of from about 6 to about 10, and more preferably at a pH in the range of from 7 to 9.

The hydrolyzed polymaleic anhydride is used at very low concentrations in the stabilizing bath of this invention (compare the suggested use of about 0.01 to about 1.0 grams per liter with the suggested use of about 5 to about 20 grams per liter in Research Disclosure, Item 22937, No. 229, May 1983.) Use of such low concentrations is believed to materially contribute to the ability of the processed photographic element to withstand the drying step and to remain essentially free from stain upon long term storage.

Application of the stabilizing composition to a photographic element is conveniently accomplished by immersion of the element in the stabilizing bath but can be carried out by other means such as surface application. The time and temperature employed for the stabilization treatment can vary widely. For example, suitable times are typically in the range of from about 0.1 to about 3 minutes, more preferably from about 0.5 to about 1.5 minutes, while suitable temperatures are typically in the range of from about 20° C. to about 50° C., more preferably from about 30° C. to about 40° C. While the stabilizing bath of this invention is typically used as the final bath in a photographic processing cycle, it can also be used as a post processing treatment. For example, it can be used to treat processed elements in which the dye images have already begun to deteriorate, in order to reduce further deterioration.

The invention is further illustrated by the following examples.

A stabilizer concentrate was prepared as follows:

| Ingredient | Concentration (g/L) |
|---|---|
| Water | 608 |
| Formalin (37% by weight solution of formaldehyde) | 115 |
| Triethanolamine | 119.4 |
| Organosilicone surfactant | 106 |
| Isothiazolone microbicide | 17.4 |

In order to evaluate the propensity for a precipitate of calcium carbonate to form in the stabilizer, tests were conducted in which 11.8 milliliters of the aforesaid concentrate were added to one liter of water to which 0.4 grams of $CaCl_2 \cdot 2H_2O$ and 0.6 grams of $KHCO_3$ had been added to simulate hard water.

Varying amounts of hydrolyzed polymaleic anhydride, available from Ciba-Geigy Corporation under the trademark BELCLENE 200, were added to the simulated hard water, as indicated below, to determine the effect on precipitate formation. The hydrolyzed polymaleic anhydride was added to the water prior to adding the stabilizer concentrate. The BELCLENE 200 has the formula:

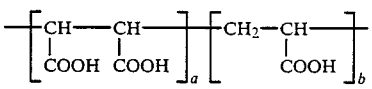

where the sum of a+b is about 8.

Results obtained were as follows:

| Test No. | Amount of BELCLENE 200 (g/L) | Appearance of Stabilizer |
|---|---|---|
| 1 | 0 | Immediate Precipitation |
| 2 | 0.01 | Clear |
| 3 | 0.02 | Clear |
| 4 | 0.03 | Clear |
| 5 | 0.05 | Clear |

The data reported above indicate that use of a hydrolyzed polymaleic anhydride in an extremely small concentration is effective in avoiding precipitate formation.

Use of a stabilizing bath in accordance with this invention has been found to provide the following advantages:

(1) excellent image stability,
(2) elimination of elemental sulfur precipitation,
(3) no adverse effects on drying such as scum formation or water spots,
(4) no biological growths, and
(5) no precipitation of calcium salts.

Use of a hydrolyzed polymaleic anhydride for the purpose described herein effectively eliminates calcium carbonate precipitation—and thereby provides a stabilizer that is suitable for use in hard water areas without demineralization of water—with no adverse effect on other stabilizer performance criteria.

In contrast with the results obtained in using hydrolyzed polymaleic anhydride, when common sequestering agents, such as ethylenediamine tetraacetic acid, diethylenetriamine pentaacetic acid, and diaminopropanol tetraacetic acid were added to the stabilizing bath to prevent the formation of calcium precipitates, accelerated image stability tests showed a significant increase in stain.

The invention has been described in detail with particular reference to preferred embodiments thereof, but it will be understood that variations and modifications can be effected within the spirit and scope of the invention.

I claim:

1. An aqueous photographic stabilizing bath for use in the color processing of photographic elements, said bath containing a dye stabilizing agent, an alkanolamine in an amount sufficient to inhibit sulfurization of said stabilizing bath resulting from carry-in of a thiosulfate fixing agent, and a hydrolyzed polymaleic anhydride or water soluble salt thereof in an amount sufficient to prevent the precipitation of calcium salts.

2. A stabilizing bath as claimed in claim 1 wherein said dye stabilizing agent is hexamethylene-tetramine.

3. A stabilizing bath as claimed in claim 1 wherein said dye stabilizing agent is a N-methylol compound.

4. A stabilizing bath as claimed in claim 1 wherein said dye stabilizing agent is an aliphatic aldehyde.

5. A stabilizing bath as claimed in claim 1 wherein said dye stabilizing agent is formaldehyde.

6. A stabilizing bath as claimed in claim 1 wherein said alkanolamine has the formula:

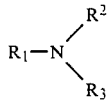

wherein $R_1$ is an hydroxyalkyl group of 2 to 6 carbon atoms and each of $R_2$ and $R_3$ is a hydrogen atom, an alkyl group of 1 to 6 carbon atoms, an hydroxyalkyl group of 2 to 6 carbon atoms, a benzyl radical, or a

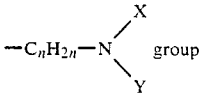

wherein n is an integer of from 1 to 6 and each of X and Y is a hydrogen atom, an alkyl group of 1 to 6 carbon atoms or an hydroxylalkyl group of 2 to 6 carbon atoms.

7. A stabilizing bath as claimed in claim 1 wherein said alkanolamine has the formula:

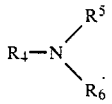

wherein $R_4$ is an hydroxyalkyl group of 2 to 4 carbon atoms and each of $R_5$ and $R_6$ is an alkyl group op 1 to 4 carbon atoms or an hydroxyalkyl group of 2 to 4 carbon atoms.

8. A stabilizing bath as claimed in claim 1 wherein said alkanolamine is triethanolamine.

9. A stabilizing bath as claimed in claim 1 wherein said hydrolyzed polymaleic anhydride or water soluble salt thereof is present in an amount of from about 0.01 to about 1.0 grams per liter.

10. An aqueous photographic stabilizing bath for use in the color processing of photographic elements, said bath containing formaldehyde in an amount sufficient to improve dye stability of said photographic elements, triethanolamine in an amount sufficient to inhibit sulfurization of said stabilizing bath resulting from carry-in of a thiosulfate fixing agent, and a hydrolyzed polymaleic anhydride or water soluble salt thereof in an amount sufficient to prevent the precipitation of calcium salts.

11. In a method for processing a silver halide photographic color element comprising the steps of treating said element in succession with a color developing solution, a bleach fixing solution or separate bleaching and fixing solutions, and a stabilizing solution; said fixing or bleach fixing solution containing a thiosulfate fixing agent which is carried by said element into said stabilizing solution; the improvement wherein said stabilizing solution contains a dye stabilizing agent, a sufficient amount of an alkanolamine to retard decomposition of said thiosulfate and resulting sulfurization of said stabilizing solution, and a sufficient amount of a hydrolyzed polymaleic anhydride or water soluble salt thereof to prevent the precipitation of calcium salts.

12. A method as claimed in claim 11 wherein said dye stabilizing agent is hexamethylenetetramine.

13. A method as claimed in claim 11 wherein said dye stabilizing agent is an N-methylol compound.

14. A method as claimed in claim 11 wherein said dye stabilizing agent is an aliphatic aldehyde.

15. A method as claimed in claim 11 wherein said dye stabilizing agent is formaldehyde.

16. A method as claimed in claim 11 wherein said alkanolamine has the formula:

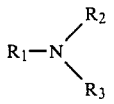

wherein $R_1$ is an hydroxyalkyl group of 2 to 6 carbon atoms and each of $R_2$ and $R_3$ is a hydrogen atom, an alkyl group of 1 to 6 carbon atoms, an hydroxyalkyl group of 2 to 6 carbon atoms, a benzyl radical, or a

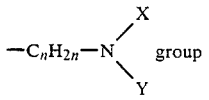

wherein n is an integer of from 1 to 6 and each of X and Y is a hydrogen atom, an alkyl group of 1 to 6 carbon atoms or an hydroxylalkyl group of 2 to 6 carbon atoms.

17. A method as claimed in claim 11 wherein said alkanolamine has the formula:

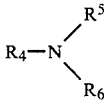

wherein $R_4$ is an hydroxyalkyl group of 2 to 4 carbon atoms and each of $R_5$ and $R_6$ is an alkyl group of 1 to 4 carbon atoms or an hydroxyalkyl group of 2 to 4 carbon atoms.

18. A method as claimed in claim 11 wherein said alkanolamine is triethanolamine.

19. A method as claimed in claim 11 wherein said hydrolyzed polymaleic anhydride or water soluble salt thereof is employed in an amount of from about 0.01 to about 1.0 grams per liter.

20. In a method for processing a silver halide photographic color element comprising the steps of treating said element in succession with a color developing solution, a bleach fixing solution or separate bleaching and fixing solutions, and a stabilizing solution; said fixing or bleach-fixing solution containing a thiosulfate fixing agent which is carried by said element into said stabilizing solution; the improvement wherein said stabilizing solution contains formaldehyde in an amount sufficient to serve as a dye stabilizing agent, triethanolamine in an amount sufficient to retard decomposition of said thiosulfate and resulting sulfurization of said stabilizing solution, and a hydrolyzed polymaleic anhydride or water soluble salt thereof in an amount sufficient to prevent the precipitation of calcium salts.

* * * * *